US005097682A

United States Patent [19]

Nakamura

[11] Patent Number: 5,097,682

[45] Date of Patent: Mar. 24, 1992

[54] ACCESSORY FOR EARRING

[76] Inventor: Azuko Nakamura, 816-70 3-Chome Mukouhara, Higashiyamato-shi, Tokyo-to, Japan

[21] Appl. No.: 629,153

[22] Filed: Dec. 18, 1990

[51] Int. Cl.[5] ..... A44C 7/00

[52] U.S. Cl. ..... 63/14.1; 63/14.2

[58] Field of Search ..... 63/14.4, 14.2, 14.8, 63/14.1, 12, 1.1, 29.1, 23

[56] References Cited

U.S. PATENT DOCUMENTS

| | | | |
|---|---|---|---|
| 20,480 | 6/1858 | Carpenter | 63/14.2 |
| 89,452 | 4/1869 | Need | 63/14.2 |
| 130,771 | 8/1872 | Tryner | 63/14.2 |
| 1,852,130 | 4/1932 | Schier | 63/14.1 |
| 1,953,437 | 4/1934 | Shier | 63/14.1 |
| 2,040,083 | 5/1936 | Elloit et al. | 63/14.2 |
| 2,410,914 | 11/1946 | Williams | 63/14.2 |
| 2,414,382 | 1/1947 | McCann | 63/14.2 |
| 2,823,525 | 2/1958 | Crigler | 63/14.1 |
| 4,727,883 | 3/1988 | Moody | 63/29.1 |

FOREIGN PATENT DOCUMENTS

| | | | |
|---|---|---|---|
| 960133 | 3/1957 | Fed. Rep. of Germany | 63/14.1 |
| 2808353 | 10/1978 | Fed. Rep. of Germany | 63/14 R |
| 2299829 | 9/1976 | France | 63/14.1 |

*Primary Examiner*—Renee S. Luebke
*Assistant Examiner*—Jerry Redman
*Attorney, Agent, or Firm*—Kramer, Brufsky & Cifelli

[57] ABSTRACT

An earring is provided, that is simple to wear and is designed to minimize potential loss of the earring by inadvertent falling off. The earring is also designed to minimize pain to the earlobe of the wearer, even when the accessory that forms a portion of the earring becomes quite large. The earring of the invention includes a body portion adapted to be inserted into the external opening of a human ear; a connector for affixing an ornamental accessory to the earring, which is attached at an upper end to the main body portion; a hook-like element attached to the lower end of the connector, adapted to be releasably clamped to the rear side of the ear; and an accessory mounted at an ornamental location on the connector.

5 Claims, 7 Drawing Sheets

ACCESSORY FOR EARRING

BACKGROUND OF THE INVENTION

1. Technical Field

The present invention relates to an earring system, and more particularly, to a novel accessory capable of wearing suitably to lower end portion of earlobe from opening end of external ear of human.

2. Prior Art and Its Problem

Earring is known from old days for an accessory for wearing to ear of human.

Wearing method of this earring is to hold by clamping the earlobe from both sides of front and rear of it.

And, clamping system by screw or elastic material and the like is usual for the holding method thereof.

However, such conventional earring includes following defects.

(a) Because of system for clamping the earlobe, pressing feeling is increased by elasping of wearing time period, and said pressing feeling may be changed to painful feeling progressively in accordance with the weight or shape of the accessory means. Accordingly, the using accessory means is limited to extremly light weighted material and selective range in designing is also extremely limited.

(b) Because the wearing to the earlobe is screwing manner or spring manner as previously mentioned, not only the wearing is annoying, and when pressure to hold to the earlobe is increased, but also pain or the like is arisen at the earlobe, while the pressure to hold to the earlobe is decreased, accident dropping from ear is likely to happen even by slight body action. Therefore, in case when expensive jewelry and the like is employed for the earing, there is inconvenience to be careful always.

Therefore, application of earing has rather difficulty for a person who likes genuine article or for a person who is in an age of unnatural for wearing an imitation.

(c) Clamping means such as screwing manner or spring manner is required for holding to the earlobe, but miniaturizing of this part is difficult and hence limitation in designing as a whole becomes greater.

Piercing to earlobe has been proposed against such disadvantage of the earring, however since it takes a structure that holding pin is directly penetrated through the earlobe whereby accessory is held as well known, (a) Accident such as dropping or losing of the accessory can be prevented, however since heavy weight article accompanies a pain due to a load of earlobe being increased, its wearing is impossible, and in this regard, selectivity of the accessory becomes greatly narrower.

(b) Because it is directly stuck and penetrated through the earlobe, it accompanies of cource physical as well as psychological pains and hence there may be a case that can never be worn for some person.

OBJECT AND SUMMARY OF THE INVENTION

The present invention is invented for solving the problems that conventional ear wearing accessories such as earring or piercing include, and it is an object of the present invention to provide an ear wearing accessory in which said ear wearing accessory is structured with "main body means to be worn at opening end portion of external ear, connecting means in which one end is fixed to said main body means while another end is clamped at approximately bottom end of the earlobe, and accessory means to be fixed at appropriate position of said connecting means", so that wearing is simple and having no worry for dropping and losing, and voluntariness of selecting the accessory can be remarkably increased because no pain is accompanied upon wearing even when the accessory means becomes rather bigger and the weight is increased.

According to the invention, since the main body means is inserted into the bottom of opening end of the external ear, and the connecting means to be fixed to said main body means is made to clamp the bottom part of the earlobe by its lower end portion, the accessory means to be worn to the connecting means is held by the bottom portion of opening end of the external ear through the main body means, and therefore the accessory means can be hung without any pain even if the weight of the accessory means is rather increased.

The forgoing and other objects as well as advantages of the present invention will become clear by following description of the invention with reference to the accompanying drawings.

BRIEF DESCRIPTION OF THE DRAWINGS

For a better understanding of the invention, and to show how the same may be carried out into effect, reference will now be made, by way of example, with respect to the accompanying drawings, in which.

Throughout the drawings, like reference numerals and symbols are used for designating like or equivalent parts or portions, for simplicity of illustration and explanation.

DETAILED DESCRIPTION OF THE PREFERRED EMBODIMENTS

Hereinafter, the preferred embodiments of the present invention will be described in detail with reference to the accompanying drawings as followings.

Figure 1:
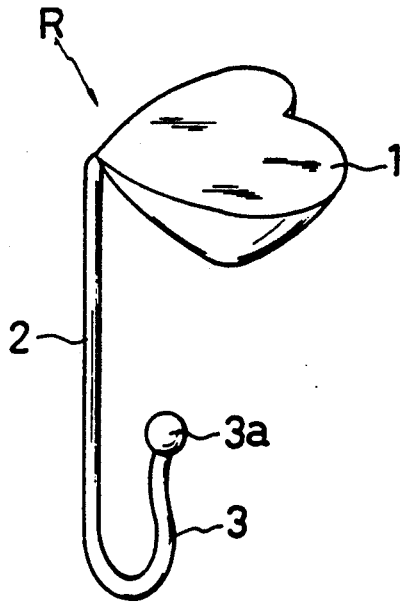
FIGS. 1 (*a*), (*b*) are diagrams for showing first embodiment of the present invention, in which FIG. 1(*a*) is a perspective view for showing external appearance, FIG. 1(*b*) is a side view thereof.
Figure 1:
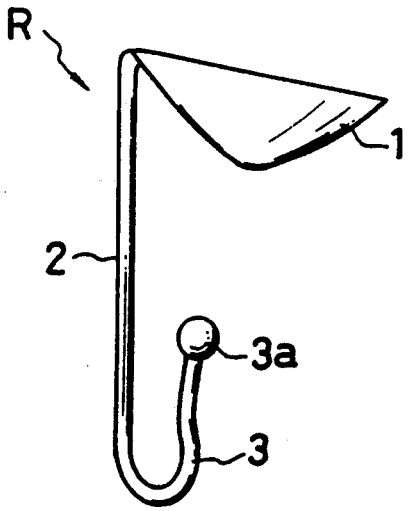

FIGS. 1(*a*), (*b*) and 2 are diagrams for showing a preferred embodiment of the present invention which is related to claims 1 and 2.

In FIG. 1 R is ear wearing accessory, reference numeral 1 is main body means, 2 is connecting means, and 3 is hook-like portion formed at lower end of said connecting means, and said ear wearing accessory R is structured with said main body means 1, connecting means 2, and various desired accessory means A to be mounted to any appropriate position of said hook-like portion 3.

Figure 2:
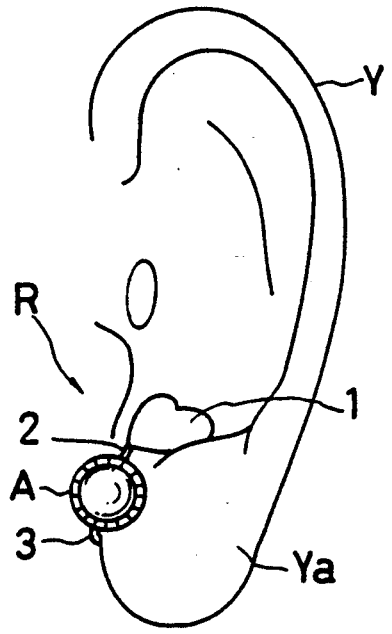
FIG. 2 is a perspective view for showing a wearing state of ear wearing accessory according to this invention.

The main body means 1 is formed with approximately heart shape in top surface so as to be able to insert into the opening end of external ear of human as shown in FIG. 2, which is structured in such shape having a cross section of approximately heart pattern, and it is made of silicone rubber in this embodiment.

The connecting means 2 is made of metallic material having flexibility or other wire material, and to which lower end portion there is formed with hook-like portion 3 so as to be able to clamp the bottom end portion of earlobe of human.

This hook-like portion 3 is formed by bending back the end portion of the connecting means 2, but at this moment, it is desirable to make so as not to be parallel with major portion of the connecting means 2, that is, said bent back portion is to be crossed with the connecting means 2. Because when it is thus crossed, it may be frimly fitted to ear in a state of clamping the earlobe to thereby become possible to surely clamp.

Reference numeral symbol 3*a* is a small ball for pressing provided at terminating end portion of the hook-like portion 3. And, in FIG. 2, reference symbol Y represents external ear of human, A represents accessory means appropriately mounted to the connecting means 2.

As shown in the drawings, the main body means 1 is inserted into the bottom of opening end of the external ear Y, and the hook-like portion 3 of the connecting means 2 clamps the lower end of the earlobe Ya, so that the ear wearing accessory R is firmly worn to the external ear Y.

Since the weight of the accessory means A is supported by the bottom of opening end of the external ear through the main body means 1 in said state, the weight is never concentrated at particular location of the external ear as conventional earing or piercing even if the weight of the accessory means A is increased, and also any pressing feeling or pain is never produced. And, since the weight for entire means is supported by the main body means elastically inserted into the bottom of opening end of the external ear and it is also made to fix to the earlobe by the hook-like portion in order to prevent any shaking, it is never released from ear by any considerable accident. Further, although it is described an example for making the main body means by silicone rubber in this embodiment, when the connecting means is covered by silicone rubber, dissimilative feeling upon wearing can be decreased and besides, when said silicone rubber is made in similar as skin color, the accessory means becomes to look better and thereby function for accessory becomes more raised.

Figure 3:
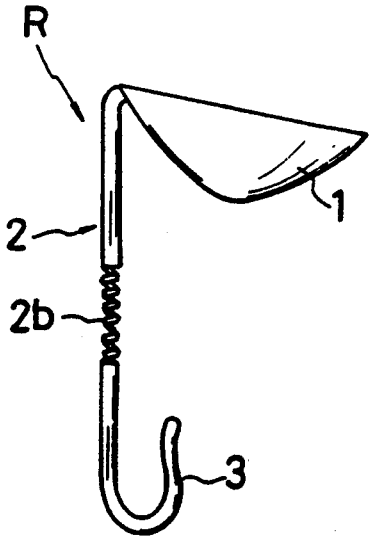
FIG. 3 is a side view for showing second embodiment of the present invention.

FIG. 3 is a diagram for showing another preferred embodiment of the present invention related to the claim 4. In this embodiment, coil spring 2*b* is provided at pertinent portion of the connecting means 2 and thereby flexibility of the connecting means 2 is improved. Thus, middle part of the connecting means 2 is formed by the coil spring 2*b*, so that the ear wearing accessory R becomes to fit with ear of any person without dissimilative feeling.

Figure 4:
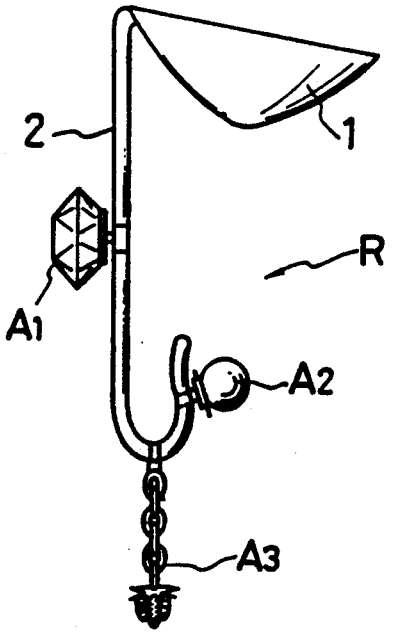
FIG. 4 is a side view for illustrating a state that accessory means are respectively fixed at appropriate positions of the connecting means so as respective accessory means are positioned at front side, rear side, and bottom side, FIGS. 5(*a*), (*b*) are diagrams for showing other embodiment of the present invention, in which FIG. 5(*a*) is an exploded perspective view for showing tube member, inserting member and the like, FIG. 5(*b*) is a perspective view for showing entire external appearance.

FIG. 4 is a diagram for illustrating the case mounted with various accessory means A1, A2, A3 to ear wearing accessory R related to this invention. Each accessory means are respectively mounted so as the accessory means A1 to be positioned at front side of ear, the accessory means A2 to be rear side of ear, and accessory means A3 to be hung at the bottom end of ear.

Thus, according to the ear wearing accessory related to this invention, entire ear can be simply made into total design.

Further, although the material of the connecting means 2 is not particularly defined in above-described embodiment, when it is made of precious metals such as gold or platinum and the like, the function as an accessory may further be raised. And, when the connecting means is made of so called pattern remembering alloy, wearing property to ear can be further improved.

Figure 5:
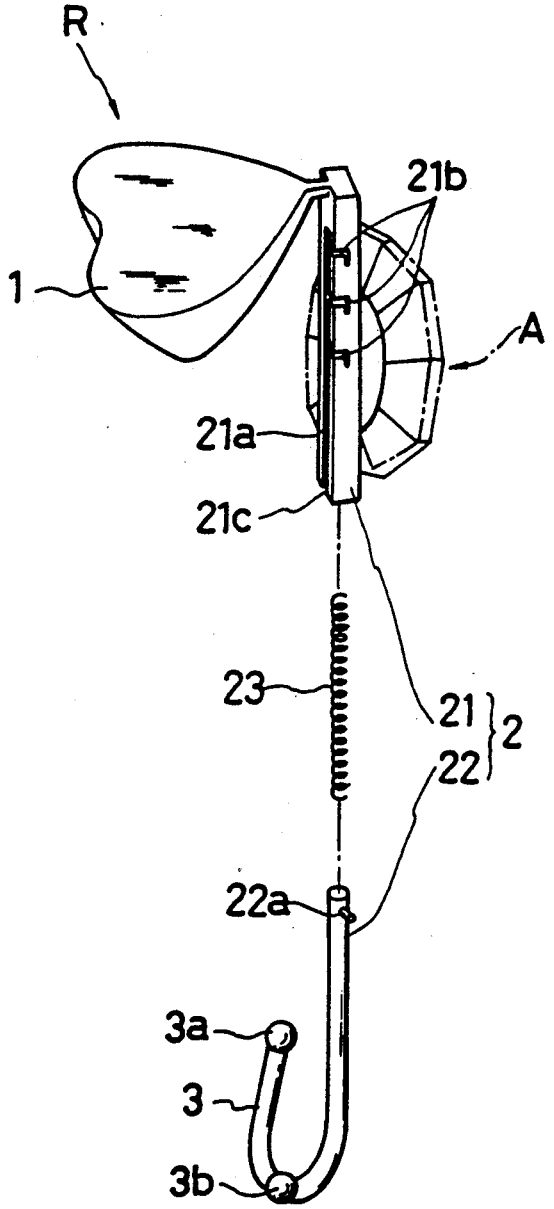
Figure 5:
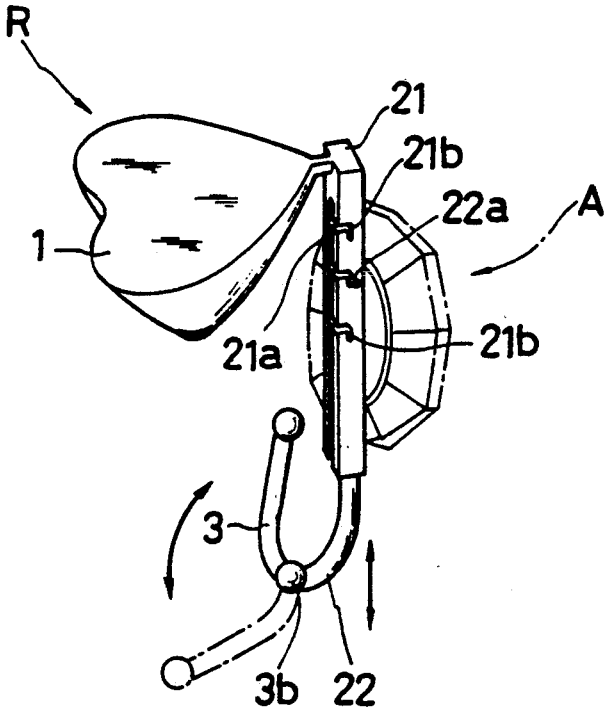

And, FIGS. 5(*a*), (*b*) are diagrams for showing still other embodiment of the present invention related to the claim 5 of this application.

In this embodiment, the connecting means 2 is structured with tube member 21 and inserting member 22 to be inserted into this so as to be extended and contracted. To said tube member 21 there are provided with cut out slot 21*a* in axial direction as a slot means and three holding holes 21*b* communicating to said slot are formed in up and down direction in turn. On the other hand, holding pin 22*a* is formed at front end of the inserting member. For inserting the inserting member 22 into the tube member 21, stopper 21*c* is released and the holding pin 22*a* is inserted into the cut out slot 21*a* and then the inserting member 22 is slided along the slot of the tube member 21. And, the inserting member 22 is rotated whereby the holding pin 22*a* is placed at the holding hole 21*b* of desired position and thereby adjusting of position of the inserting member 22 relative to the tube member 21 is executed, in other word, adjusting of length of the connecting means 2 is made possible, so that wearing degree to the ear can be adjusted.

Futhermore, the hook-like portions 3 is mounted to the connecting means 2, more particularly to the inserting member 22 so as to be able to freely open and close, so that wearing to the earlobe is made in easy.

In addition, in the drawings, reference numberal symbol 3*b* is opening and closing mechanism of the hook-like portion 3, which is normally made to elastically fix the hook-like portion 3 to closed position, that is, solid line position shown in FIG. 5(*b*). And, reference numeral 23 in FIG. 5(*a*) is coil spring for elastically holding the inserting member 22 into the tube member 21. This spring is inserted within the tube member 21 and thereby it is made to either constantly press the inserting member to downward, or inversely to constantly urge to upward. The holding pin 22*a* of the inserting member 22 and the holding hole 21*b* of the tube member 21 are firmly coupled by said spring.

Figure 6:
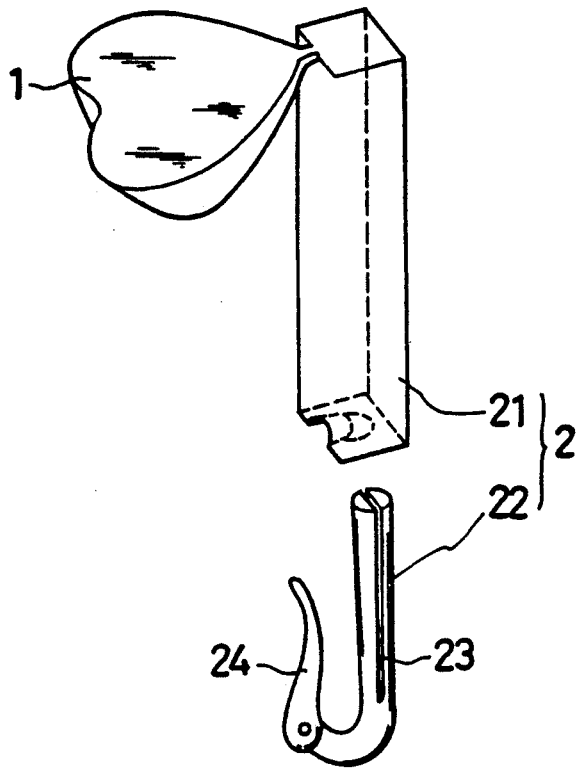
FIG. 6 is a perspective view for showing third embodiment of the present invention.

FIG. 6 is a diagram for showing further embodiment of the present invention related to the claims 6 and 7.

In this embodiment, the connecting means 2 is structured with tube member 21 and inserting member 22 to be inserted into said tube member 21 so as to be freely extended or constracted.

And, the inserting member 22 is formed with slit 23 in its axial direction whereby elastic coupling to the tube member 21 is made possible, and as a result of this, the inserting member 22 can be fixed at desired position of the tube member 21.

As shown in the drawing, lower end portion of the inserting member 22 is formed in U-shape and clamping portion 24 is mounted through a spring mechanism to its end portion.

The clamping portion 24 becomes to press the rear side of earlobe by said spring mechanism toward the tube member 21 and thereby the ear wearing accessory R can be firmly fixed at a predetermined position of ear.

Figure 7:
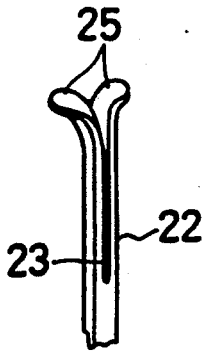
FIG. 7 is a fragmentary perspective view for showing another example of the tube member.

FIG. 7 is a diagram for showing another example of the inserting member 22. In this example, a pair of protrusions 25 are formed at top end portion of the inserting member 22.

The inserting member 22 can be elestically coupled into the tube member 21 more easily by said protrusions 25.

Figure 8:
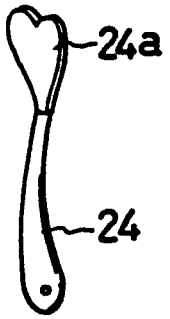
FIG. 8 is a fragmentary perspective view for showing another example provided with a presser at front end of calmping portion.

FIG. 8 is a diagram for showing a case provided with a presser of heart shape at front end of the clamping portion 24, and pressing to the earlobe becomes easier by this.

Figure 9:
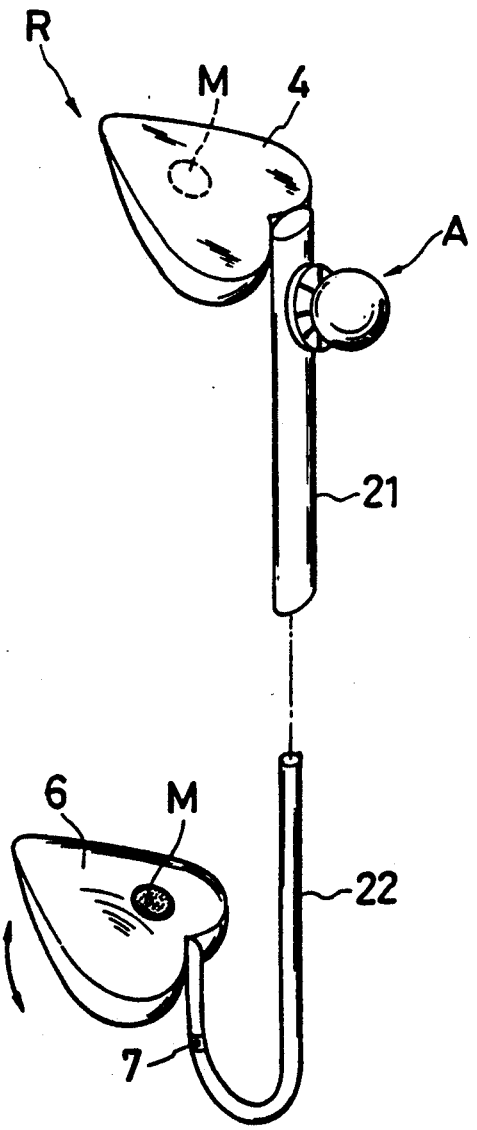
FIG. 9 is an exploded perspective view for showing structural state of still other embodiment according to the present invention.
Figure 10:
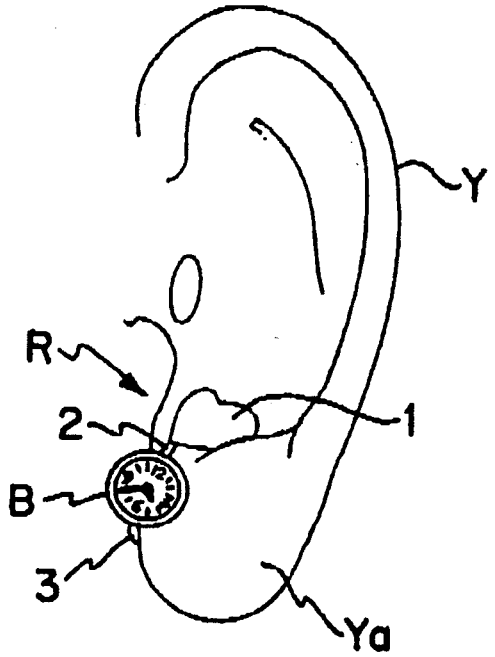
FIG. 10 shows an accessory means (B) that can be a watch that informs of the time by sound.

FIG. 9 is a diagram for showing still further embodiment of the present invention related to the claim 8 of this application.

In the drawing, reference numeral 4 is upper holding means, and which froms approximately heart shape in top surface in order to wear at bottom of opening end of the external ear, and its bottom surface is formed in a shape to be gradually reduced in diameter by going along to downward.

And, reference symbol M is magnet buried at bottom side surface portion of the upper holding means.

Further, reference numeral 22 is inserting member, and it is formed with a bar material of U-shape, and one side standing portion is to be inserted into the tube member 21 to thereby be made to be able to slide in up and down direction.

Reference numeral 7 is adjusting portion formed at another side standing portion of the inserting member 22, and said standing portion is made to be able to adjust to a predetermined angle.

And, reference numeral 6 is lower holding means, and it is fixed at top end of another standing portion of the inserting member 22, and in order to wear to the rear side surface of ear, its top surface is formed in concave and being formed in approximately heart shape as shown in the drawing.

To the top surface of said lower holding means 6, magnet M corresponding to aforementioned upper holding means 4 is buried.

And reference symbol A is accessory means mounted to the tube member 21.

This ear wearing accessory R is worn with upper holding means 4 at the bottom of opening end of the external ear, and lower holding means 6 is worn so as to be positioned at rear side surface of ear confronting to uper holding means 4.

Therefore, the ear wearing accessory R can be worn readily and appropriately at ear portion without feeling any dissimilative feeling such as strong tightening according to the mutual attracting force of each magnets M, M of respective holding means 4, 6.

And, magnetic force which serves to wear said ear wearing accessory R is of course harmless for human body as well known, but it brings good operation for hemoglobin within blood, and it is possible to reduce loading feeling which is felt from self weight of the ear wearing accessory R.

Further, although the wearing accessory is described on the assumption of usual jewel or the like in aforementioned respective embodiments, watch informing the time by sound instead of such accessory means or together with accessory means may be mounted.

That is, when a watch having a mechanism outputting the time informing sound recorded to IC' in response to the signal from watch is mounted, it becomes possible to know the time directly at ear voluntarily.

Since the present invention comprises above-described contruction and operation, following effects can be obtained.

(a) Stress feeling and painful feeling are not present even if wearing for long time period.

(b) since it is not easily released, there is no worry of dropping or losing and it is not necessary to pay excessive care even when wearing expensive jewelry and the like.

(c) Wearing is simple.

(d) Since the accessory means can be attached not only to front side of ear but rear side as well as bottom side, free range of design as accessory becomes greatly bigger.

It will be appreciated that the present invention is not restricted to the particular embodiment that has been described hereinbefore, and that variations and modifications may be made therein without departing from the spirit and scope of the invention as defined in the appended claims and equivalents thereof.

I claim:

1. An earring comprising:

a tube member having a top end fixed to an upper holding means and extending downwardly;

an inserting member which is formed with a U-shaped bar member including a first vertical section adapted to be inserted into said tube member so as to be able to slide in an up and down direction and further including adjusting means capable of adjusting the angle of a second vertical section of said inserting means;

lower holding means fixed at a top end of the second vertical section, said lower holding means having a concave surface on the top surface thereof and to be worn on a rear side of a human ear and forming approximately a heart shape, and being provided with a magnet; and accessory means mounted at said tube member.

2. An earring according to claim 1, wherein said accessory means is a watch informing of the time by sound.

3. An earring comprising:

a main body means adapted to be inserted into the external opening of a human ear;

connecting means for affixing an ornamental accessory to an earring, said connecting means being attached at an upper end to the main body means;

a hook-like element attached to a lower end of said connecting means and adapted to be releasably clamped to the rear side of a human earlobe; and accessory means for mounting at an appropriate position on the connecting means;

wherein the connecting means comprises a tube member and an insert member to be inserted into the tube member so that the length of the connecting means can be freely adjusted, the tube member including a slot extending longitudinally therein and further including a plurality of holes in communication with the longitudinally extending slot for receiving a holding pin mounted on the inserting member, said pin adapted to be slidably inserted into the longitudinally extending slot and inserted into one of the holding holes upon determining the desired length of the connecting means.

4. An earring comprising:

a main body means adapted to be inserted into the external opening of a human ear;

connecting means for affixing an ornamental accessory to an earring, said connecting means being attached at an upper end to the main body means;

a hook-like element attached to a lower end of said connecting means and adapted to be releasably clamped to the rear side of a human earlobe; and accessory means for mounting at an appropriate position on the connecting means;

wherein the connecting means comprises a tube member and an insert member to be inserted into the tube member so that the length of the connecting means can be freely adjusted, and wherein the insert member is formed at one end with an axially extending slit for enabling an elastic coupling to the tube member and the hook-like element is attached to the other end of the insert member of the connecting means.

5. An earring according to claim 4, wherein the end of the insert member that is attached to the hook-like element is U-shaped and said hook-like element is mounted to the U-shaped insert member with a spring mechanism.

* * * * *